US006110018A

United States Patent [19]

Hepworth

[11] Patent Number: 6,110,018

[45] Date of Patent: Aug. 29, 2000

[54] APPARATUS AND METHODS OF SHARPENING CUTTING TOOLS

[75] Inventor: Paul Steabben Hepworth, Guildford, United Kingdom

[73] Assignee: Plasplugs Inc., Lakewood, N.J.

[21] Appl. No.: 09/068,708

[22] PCT Filed: Dec. 20, 1996

[86] PCT No.: PCT/GB96/03190

§ 371 Date: May 14, 1998

§ 102(e) Date: May 14, 1998

[87] PCT Pub. No.: WO97/22440

PCT Pub. Date: Jun. 26, 1997

[30] Foreign Application Priority Data

Dec. 20, 1995 [GB] United Kingdom ..... 9526055
Oct. 1, 1996 [GB] United Kingdom ..... 9620580

[51] Int. Cl.[7] ..... B24B 1/00; B24B 41/06

[52] U.S. Cl. ..... 451/48; 451/375; 451/376; 451/386; 451/387; 451/391; 451/420

[58] Field of Search ..... 451/48, 374, 375, 451/376, 386, 387, 391, 419, 420, 278, 279

[56] References Cited

U.S. PATENT DOCUMENTS 2,932,924 4/1960 Zachow .
3,494,080 2/1970 Laguna .
3,838,540 10/1974 Steinmetz .
4,142,332 3/1979 Clarke ..... 51/125
4,547,999 10/1985 Reiling et al. .
4,658,549 4/1987 Lockwood .
4,916,867 4/1990 Lockwood ..... 51/96
5,788,559 8/1998 Jungnitsch ..... 451/48

FOREIGN PATENT DOCUMENTS 1008097 10/1965 United Kingdom .
WO 93/14903 8/1993 WIPO .

*Primary Examiner*—Timothy V. Eley
*Attorney, Agent, or Firm*—Michaelson & Wallace; Peter L. Michaelson

[57] ABSTRACT

An adapter for use with a powered grinding tool having a driven grinding wheel has a pivotally mounting part on a body thereof, and a drill bit holder engageable with the mounting part in either of two orientations for sharpening a tip of a drill bit clamped in a set position in the drill bit holder at the grinding wheel, the engagement being completed when the drill bit engages on a stop bar at the front of the mounting part. Also disclosed is a setting arrangement for setting the drill bit in its holder including stop means for engagement by the drill tip upon longitudinal setting of the drill bit, and drill rotation setting means slidable relative to the stop means for rotational setting of the drill bit. A powered grinding tool having the features of the adapter formed as part thereof is also disclosed.

29 Claims, 3 Drawing Sheets

125
126
122
127
121
111
110
120
119
117
118
113
122
145
129a
130
132
136
133
149
147
140
144
146
139
135
133
136
129
128
132
143
145
131
141
137a
137b
142
112
115
114
135
133
136
134
119
144
131
137a
118
126
125
124
116
125
126
120
116
140
143
124
138
137a
141
139
124
C
C
116
139a

APPARATUS AND METHODS OF SHARPENING CUTTING TOOLS

BACKGROUND OF THE INVENTION

A. Field of the Invention

This invention relates to improvements in drill bit sharpening means, and particularly to an adapter for a power tool of the general form described and shown in our PCT Applications Nos. GB93/00079 (WO93/14903) and GB95/00447 (WO95/23672).

B. Description of the Prior Art

In said PCT applications there is disclosed a powered grinding tool having a motor adapted to be driven by power supply means, a rotatable shaft drivable, in use, by the motor, and a rotatable grinding wheel to which drive is transmitted, in use, from said shaft. Such a powered grinding tool will hereinbefore be referred to as being of the kind specified. Adapters are described for releasable engagement with said tool. However the feature(s) for working an implement provided by each adapter can be provided as part of the tool if the 'adapter' is formed as a non-releasable part of the tool.

SUMMARY OF THE INVENTION

According to one aspect of the invention there is provided an adapter for use with a powered grinding tool of the kind specified, the adapter comprising a body having a mounting part, and a drill bit holder engagable with said mounting part in either of two orientations, the mounting part having location means engagable, in use, by the holder and/or a drill bit carried by said holder, the arrangement being such that, in use, the drill bit can be sharpened by said grinding wheel upon engagement of the holder with said mounting part, said engagement being completed when the holder and/or the drill bit engages said location means, engagement of the holder in its said two orientations respectively allowing for sharpening of respective opposite faces/edges of the drill bit.

According to another aspect of the invention said 'adapter' is formed as part of the grinding tool, instead of being separately releasably fittable thereto, so that a self-contained sharpener tool is provided.

According to a still further aspect of the invention there is provided a setting arrangement for setting, in a drill bit holder, a drill bit having a tip to be sharpened, the drill bit holder intended to be located adjacent grinding means for effecting sharpening the tip of the set drill bit, the setting arrangement comprising engagement means for releasably engaging the drill bit holder during setting, stop means for engagement by said drill tip upon longitudinal setting movement of the drill bit in said drill bit holder, and drill rotation setting means movable relative to the stop means and having an engagement surface, the operation being such that, in use, with the drill rotation setting means disposed in a forward position relative to the stop means, said longitudinal setting movement of the drill bit causes one side of the tip thereof to engage said engagement surface of the setting means and, if the tip is spaced from the stop means, to move the setting means relative to the stop means until the tip engages the stop means, the drill bit being in its correct rotational orientation when the drill bit is in engagement with the stop means, said one or another side of the drill bit tip is in engagement with said engagement surface, and rotation of the drill bit causes no movement of the setting means relative to the stop means.

Preferably the engagement surface is a surface at an angle to the direction of longitudinal setting movement of the drill bit. Desirably the engagement surface is one of a pair of engagement surfaces defining a V-shaped recess in the front of the setting means, and conveniently the surfaces converge to a central slot through the setting means which receives the stop means relative to which the setting means can slide.

BRIEF DESCRIPTION OF THE DRAWINGS

The invention will now be described, by way of example, with reference to the accompanying drawings, in which.

DETAILED DESCRIPTION

Figure 1:
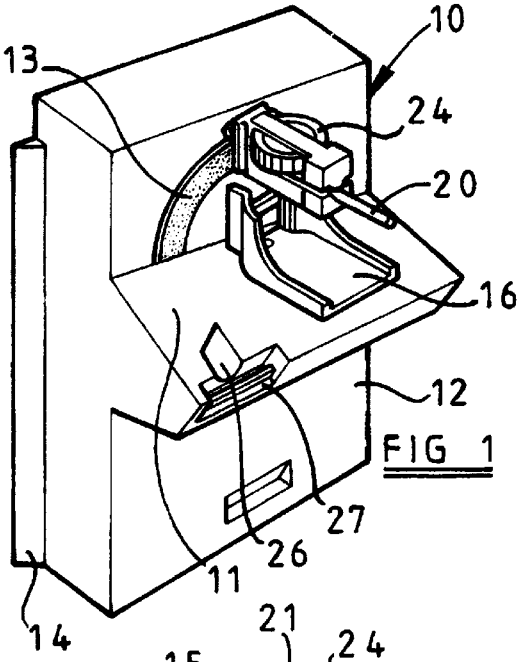
FIG. 1 is a schematic front perspective view of an adapter of one aspect of the invention for use with a powered grinding tool for sharpening drill bits, a grinding wheel of the tool also being shown.

As mentioned hereinabove, this invention relates, in one aspect, to an adapter for use with, or as part as, a powered grinding tool of the general form described and shown in said PCT Applications. The tool forms no part of the present invention, and will thus not be described, reference being made to said PCT Applications for details thereof.

The adapter 10 has a casing body with a downwardly and outwardly sloping platform 11 across its front face 12, approximately mid way between its upper and lower ends. The interior of the body is adapted to receive therein a grinding wheel 13 of the powered grinding tool, to which the adapter is releasably fitted in the usual manner, for example by projections on its opposite outer sides slidably engaging with vertical complementary slots at opposite sides of the working face of the tool, or vice versa. One projection 14 is shown, and latch means of the tool would automatically engage the adapter, in use, to retain it in place, so that the wheel 13, which is accessible at an open part of the front face 12 above the platform, is correctly positioned relative to the adapter platform.

The adapter is intended for use with the powered grinding tool for sharpening drill bits, e.g. standard bits for twist drills, bits for split point drills etc. To this end the adapter also comprises a drill bit holder 15, which is slidably engagable in either of two orientations, 180° apart, with a mounting cradle 16 angularly movably mounted on the platform 11.

Figure 2:
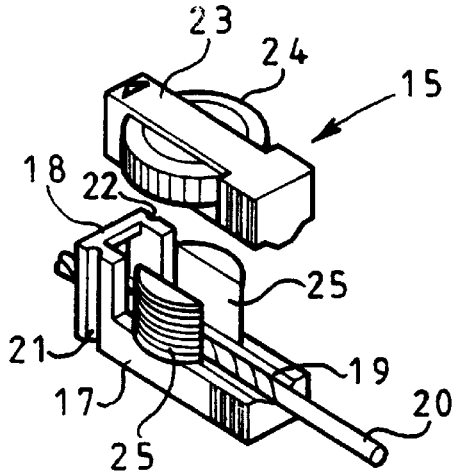
FIG. 2 is an exploded view of a drill bit holder of the adapter.

The drill bit holder is shown best in FIG. 2. It has a base 17 in the form of a V-block, with an upstanding end 18 through which the V-groove 19 continues, the groove being to receive a drill bit 20 as shown. Opposite upright sides of the end 18 are formed with respective outwardly facing grooves 21, 22. The drill bit is clamped, in use, in the V-groove by a top jaw 23 which has a slot therein in which is received a knurled circular nut 24 having an internal screw thread. The nut is threadedly engaged with a split, externally threaded moulded bolt 25, the opposite sides of which are on opposite sides respectively of the V-groove. Thus by screwing the nut down onto the bolt, the drill bit can be clamped by the jaw 23 in an adjusted position and orientation in the groove 19.

In order accurately to set the drill bit in the holder, so that it can be correctly ground when the holder is engaged with the cradle 16, the platform is provided with a locating slot 26 communicating with a configurated recess 27 at a front edge of the platform, at which the holder is arranged to engage and locate. The slot 26 is generally semicircular in cross-section, extending normal to the recess 27. The slot has an angled inner end face 28, for a purpose to be explained.

The mounting cradle 16 has a base 29 on the sloping platform 11, with a pair of side arms 30, 31 respectively upstanding normally therefrom, these being cut down away from the front of the cradle adjacent the rear of the platform 11. Opposite inner surfaces of the respective arms 30, 31 at the end of the cradle adjacent the rear of the platform are formed with respective tongues 32, 33 or equivalent which are complementary in shape to the grooves 21, 22 of the holder 15. In this way, the holder can be slidably engaged with the cradle through the relative movement of the tongues into said grooves.

A horizontal datum cross-bar or stop-bar 34 extends between the arms 30, 31 at the end of the cradle where said tongues are formed, this stop-bar bar however lying outwardly of the tongues and being disposed approximately half way between the top and bottom of this cradle end. The cradle is pivotally mounted on the platform 11 by a pivot 35 at the base 29.

Figure 8:
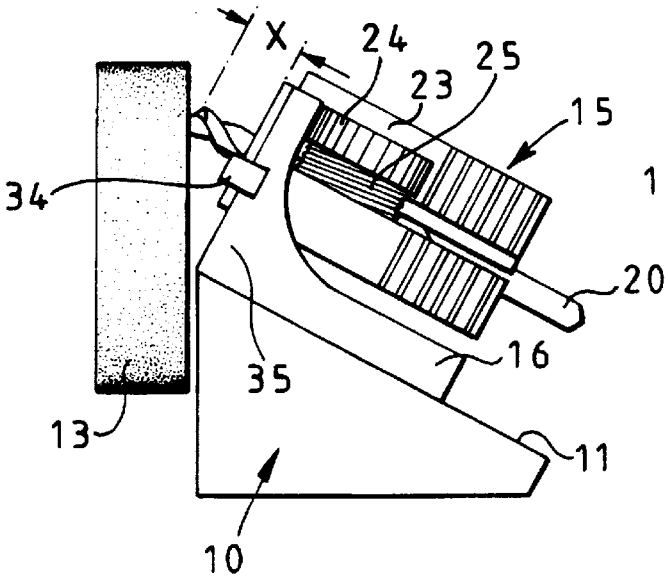
FIG. 8 is fragmentary side view showing the holder fully engaged with the mounting cradle.

In use, a drill bit 20 to be sharpened is placed in the V-groove 19 with the top jaw 23 well spaced therefrom, and possibly even separated from the base 1 7. The jaw 23 is then screwed down onto the base until the drill bit is loosely held in the groove 19. The drill bit needs to be clamped so that it projects by the sum of a distance X (FIG. 8) and a further small distance Y (FIG. 5) corresponding to the amount of sharpening required. Also it needs to be rotationally orientated so that the drill edges can be correctly offered to the wheel 13 during sharpening. These requirements can be met in a variety of ways, the simplest being by ruler and eye. However in this example, the slot 26 is intended to be used.

Figure 3:
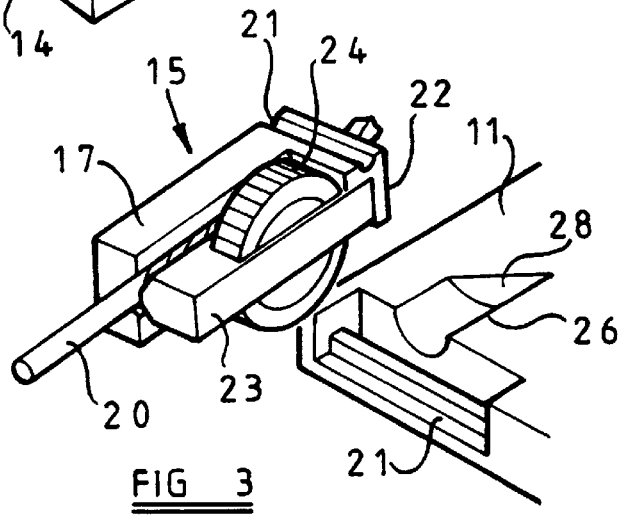
FIG. 3 shows how the drill bit holder is positioned at a location of a body of the adapter correctly to set the drill bit position in the holder.
Figure 4:
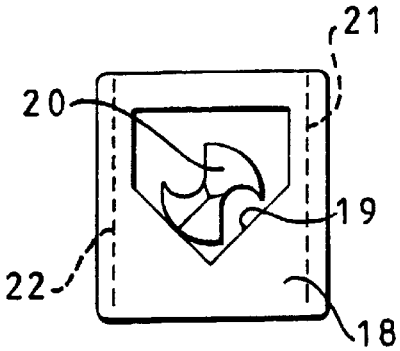
FIG. 4 is an enlarged end view of the drill bit correctly positioned in the holder.
Figure 5:
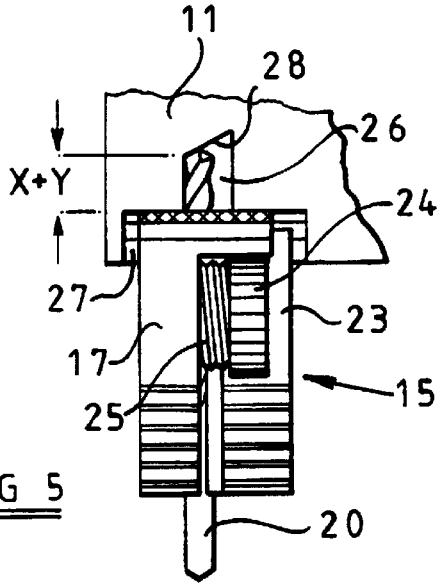
FIG. 5 is a plan view of the holder at said location of the body with the drill bit correctly positioned.
Figure 6:
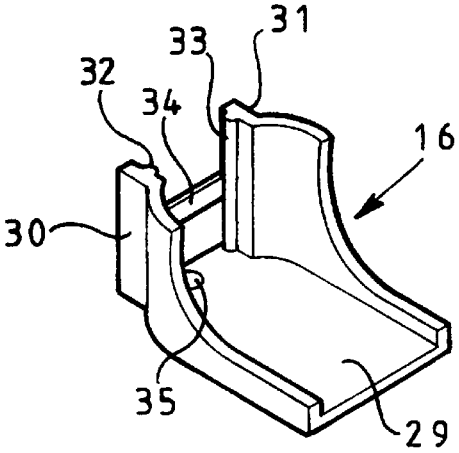
FIG. 6 is a perspective view of a mounting cradle of the adapter.
Figure 7:
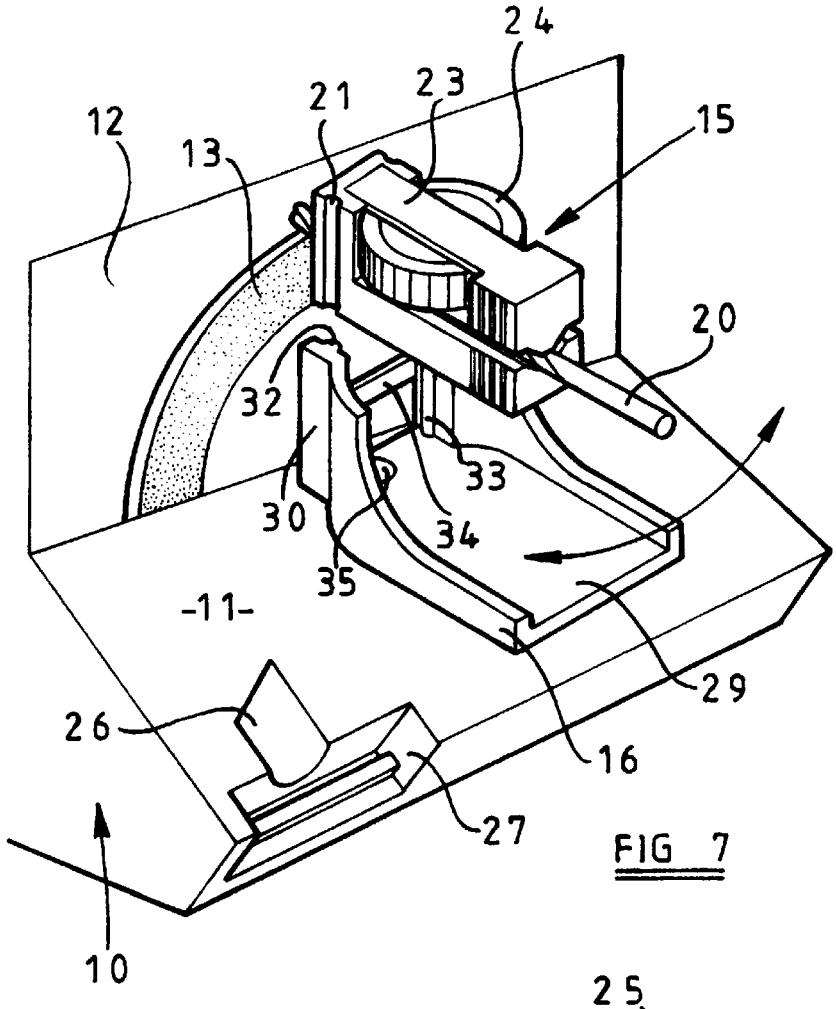
FIG. 7 is a schematic, fragmentary perspective view of the adapter with a drill bit holder in position to be fitted to a mounting cradle in one of its orientations.

Accordingly after manually adjusting the loosely held drill bit 20 in the groove 19 to a first guess at its correct axial and rotational state, the holder is positionally engaged on the platform 11 at the recess 27, with the drill bit being received in the slot 26, as shown in FIGS. 3 and 5. The drill bit is manually adjusted so that it lies against the shorter side of the slot, with its end engaging against the angled slot end face 28 (FIG. 5). The drill bit now extends from the holder by the required distance of X+Y. Additionally, the drill bit is rotated to align one of its opposite cutting faces/edges with the face 28, thereby providing the correct rotational orientation for sharpening (FIG. 4). With the drill bit now set in its holder, the top jaw is screwed down tightly onto the base 17, so as to clamp the drill bit in its correctly adjusted position.

Figure 9:
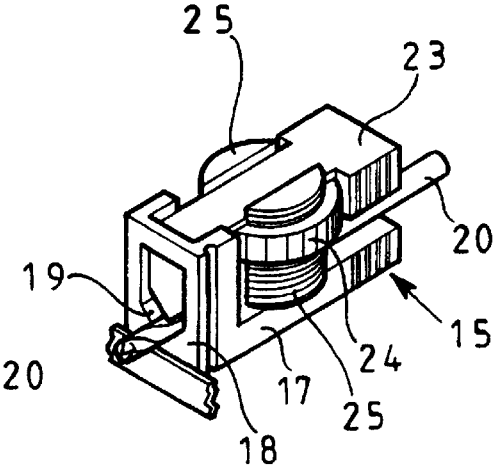
FIG. 9 is a fragmentary perspective view of the holder with the drill bit carried thereby engaged against stop means of the mounting cradle.

The holder is now transferred to the cradle 16 and slidingly engaged therewith as described previously, by gradually lowering it towards the base 29. Simultaneously with said lowering, it is intended that the cradle is swung about its pivot 35 from side to side. Accordingly the one drill bit face is sharpened by the rotating grinding wheel as the lowering and swinging movement takes place. The lowering terminates when the drill bit engages the stop-bar 34 (FIG. 9), this corresponding to a projection of the drill bit from its holder by the distance X (FIG. 8), with the distance Y corresponding to the amount of the bit ground away by the sharpening process. The opposite drill bit face of the two faces shown in FIG. 4 is sharpened by removing the holder from the cradle, turning it through 180° and re-engaging the holder by lowering it as described until the drill bit engages the stop-bar. Instead of this engagement being by the drill bit, it could instead be by part of the holder, or by both the drill bit and the holder.

The process described ensures that the two faces are ground symmetrically, because each grinding operation stops when the datum cross-bar is engaged by the drill bit. This arrangement can be used with standard twist drill bits and also split point drill bits and others.

The cradle can be provided with adjustable stops to control the angular movement thereof to give appropriate backing off and cutting angle. It could also be tiltable by suitable means to vary the drill tip angle. Such features are particularly desirable when sharpening split point drill bits.

Instead of the grooves and tongues described for slidably engaging the holder on the cradle, it would be possible to use the reverse arrangement or any suitable alternative means, i.e. holes which locate on pins, dovetail slots, or other variations which provide location with only one degree of freedom of movement.

The provision of the stop-bar compensates for the fact that although a small diameter drill bit engages in the V-groove as shown in FIG. 4, a larger diameter drill bit engages further up the side of the groove.

The illustrated embodiment of the invention thus provides a relatively simple drill bit holder engagable with a simple cradle in a controlled manner, i.e. only generally perpendicular to the drill bit axis. The holder can be easily lifted from the cradle, turned over and replaced, to grind the other drill face. Grinding is easily effected by angular movement of the cradle whilst pressing down the holder until the drill stops against a datum cross-bar. This guide feature and datum cross-bar ensures that each side is ground identically.

Instead of the adapter being separate from the tool, the sharpening 'means' provided could be incorporated in an arrangement which is fixed to a grinding tool. Thus a self contained drill bit sharpening tool would be formed which provides the advantageous features of the adapter sharpener system referred to, even though it does not require a separate adapter.

Instead of using the location slot 26 and recess 27 of the platform to set the drill bit to be sharpened, there is now described an alternative arrangement where setting is carried out at the mounting cradle component. As with the embodiment of FIGS. 1 to 9, the arrangement, which is also itself separately inventive according to another aspect of the invention, is applicable either with a separate adapter or with a self-contained powered grinding tool where the features of the adapter are an integral part of the tool. However for consistency with the description of the embodiment of FIGS. 1 to 9, this alternative embodiment will be described in relation to a separate adapter which is releasably engageable with a separate powered grinding tool.

Figures 10, 11, 12, 13, 14, 15, 16:
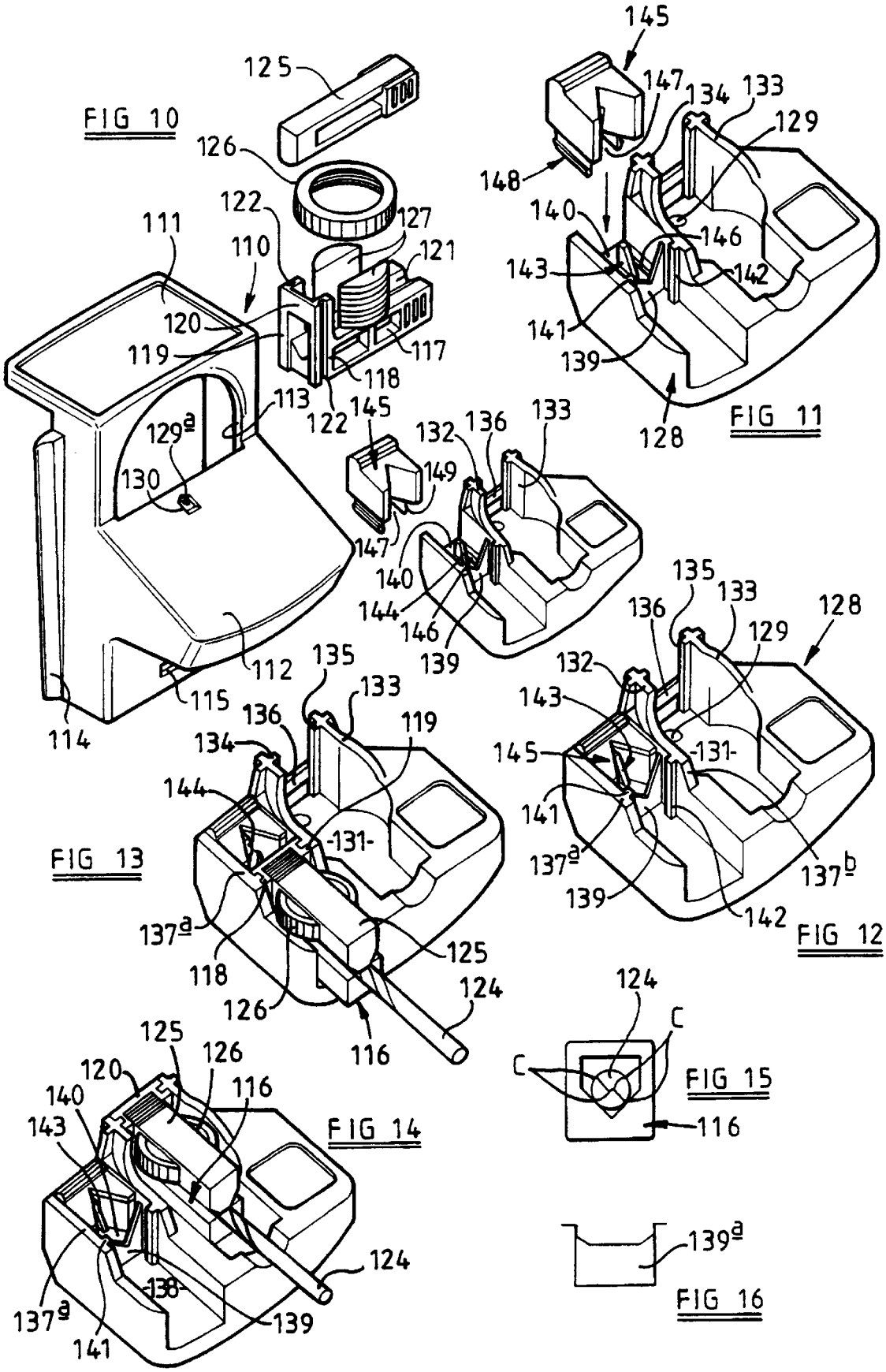
FIG. 10 is an exploded perspective view of a further adapter of said one aspect of the invention, the adapter incorporating a drill bit setting arrangement of a further aspect of the invention.
FIG. 11 is an enlarged perspective view of part of the adapter of FIG. 10.
FIG. 12 is a view like FIG. 11, with a drill rotation setting component shown fitted in position.
FIG. 13 is a view like FIG. 12, with a drill bit holder fitted in position for drill bit setting.
FIG. 14 is a view like FIG. 13, with the drill bit holder and the drill bit set therein engaged with a mounting cradle part of the adapter ready for sharpening.
FIG. 15 is a scrap view showing a drill bit tip correctly set up in the drill bit holder in respect of its rotational orientation.
FIG. 16 is a scrap view of an alternative form of a wall of part of the setting arrangement.

The basic body of the adapter 110 shown in FIG. 10, is very similar to that of the first embodiment, but has a slightly greater rearwardly extending top wall 111. The adapter body has a platform 112 sloping downwardly and outwardly across its front face, in the same manner and with the adapter of the first embodiment and has its front face above the platform formed with an opening 113 at which a grinding wheel (not shown) is received flush. One projection 114 is shown at the front left hand side of the adapter body to enable the adapter to be releasably fitted in the usual manner with the powered grinding tool, the other projection at the opposite side of the body not being shown. In the front face of the adapter body below the platform 112 there can be provided a slot 115 for latching the adapter to the tool body, although releasable latching engagement can be provided between the grinding tool body and the adapter in any other convenient manner.

As with the first embodiment, the adapter is intended for use with the powered grinding tool for sharpening drill bits, e.g. standard bits for twist drills, bits for split point drills etc. A drill bit holder of similar form to that of the first embodiment is still provided, and, for the sharpening operation, this is still engaged with a mounting cradle which is angularly movably mounted on the platform 112. However as will be described, the means for setting the drill bit in the drill bit holder is no longer formed on the platform, but is instead incorporated into and alongside the component which includes the mounting cradle, as shown, for example in detail, in FIG. 11. Additionally the setting means now incorporates an improved method of catering for differently sized drills, as will be described hereinafter.

As shown best in FIG. 10, the drill bit holder 116 has a base 117 in the form of a V-block, with its one end being formed by a pair of spaced, upstanding parallel sides 118, 119 respectively connected by a crosspiece 120 spaced above the V-groove 121 which continues to the end of the block. The respective outer surfaces of the upstanding sides 118, 119, are formed with respective grooves 122. The drill bit 124 is clamped, in use, in the V-groove by a top jaw or clamp bar 125 which has a slot therethrough in which is received a knurled circular nut 126 having an internal screw thread. The nut is threadedly engaged with a split, externally threaded moulded bolt 127, the opposite sides of which are on respective opposite sides of the V-groove. Thus by screwing the nut down onto the bolt, the drill bit can be clamped by the top jaw 125, so that drill bit 124 can be adjustably positioned with a particular orientation in the groove 121.

In the first embodiment, there is provided a mounting cradle 16 which is angularly movably mounted on the platform of the adapter, the cradle providing means for engaging the drill bit holder therewith so that with the drill bit having been correctly set in the holder, the holder is then correctly positioned relative to the grinding wheel for correct sharpening of the drill bit tip. With the illustrated embodiment of the present invention, the mounting cradle is formed as part of a swivel base component 128 in the form of a plastics material moulding, the base component 128 also incorporating, as part thereof, a setting arrangement to enable the position and orientation of the drill bit 124 correctly to be set. As with the mounting cradle 16, the base component 128 is again arranged to be angularly movably mounted on the platform 112, the rotation axis being denoted at 129 for component 128, and for platform 112 at axis 129*a* in a recess 130 generally at the centre of the rear of the platform adjacent the opening 113, as shown in FIG. 10. However the base component 128 could be pivotally arranged on the platform 112 by any other convenient means, so that, as will be described, it can be angularly moved about the plane of the platform 112 to provide the necessary sharpening of the drill bit tip.

The mounting part of a component 128 is of similar form to the mounting cradle 16, in that it provides a base 131 on which the drill bit holder is received. The mounting part has a pair of side arms 132, 133 respectively upstanding normally from the base, these being cut down away from the front of the mounting part which is adjacent the rear of the platform 112. These side arms are formed with facing arcuate portions to accommodate nut 126 when the holder 116 is inverted to engage the mounting part, as will be described. Opposite inner surfaces of the respective side arms are formed with respective tongues 134, 135 or equivalent which are complimentary in shape to the grooves 122, 123 of the drill bit holder 116. In this way, the holder can be slidably engaged with the mounting part through the relative movement of the tongues into said grooves. In the engaged position, the base 117 engages on the base 131 of the mounting part.

A horizontal datum cross-bar or stop-bar 136, preferably of metal, extends between the arms 132, 133 at the end of the mounting part where the tongues are formed, this stop-bar lying outwardly of the tongues and being disposed approximately half-way between the top and bottom of this mounting part end. This stop-bar is thus of the same form as stop-bar 34 of the mounting cradle 16. At the front end of the mounting part, there is an upstanding end surface formed at its upper extremity with a semi-cylindrical recess to accommodate the end of the drill bit which projects from the drill bit holder.

In use, a drill bit 124 to be sharpened is placed in the V-groove 121 with the top jaw 125 well spaced therefrom, and possibly even separated from the base 117. The jaw 125 can be screwed down onto the base until the drill bit is loosely held in the groove 121. The drill bit needs to be clamped so that it projects by the sum of a distance X and a further small distance Y corresponding to the amount of sharpening required, these distances being as shown and described with the first embodiment, and in particular in relation to FIGS. 5 and 8. Additionally the drill bit needs to be rotationally orientated so that the drill edges can be correctly offered to the grinding wheel during sharpening. These requirements can be met in a variety of ways, the simplest being by ruler and eye. However in this example, the base component 128 provides suitable setting means alongside the mounting part thereof, and an aspect of the present invention relates to this setting arrangement per se. As previously mentioned, the setting arrangement could be formed instead on a fixed or moveable part of a self-contained powered sharpening tool, rather than on a fixed or moveable part of an adapter for releasable engagement with a powered grinding tool. Although it is convenient for the setting arrangement to be on the same component as that which provides the mounting part for the drill bit holder, this is not essential, and the setting arrangement could instead be provided on a separate part of the adapter, e.g. as with the first embodiment, on part of the platform 112. Clearly, however any setting is related to the subsequent use of the 'set' holder at the mounting part of component 128.

As illustrated, the setting arrangement comprises a first channel having parallel sides 137*a*, 137*b* and a flat base 138. The inner end of this first channel is closed by a wall 139 normal to the base 138, and having, in the illustrated embodiment a central V-shaped notch in its upper surface. However in an alternative preferred form of wall 139, diagrammatically shown as 139*a* in FIG. 16, the upper surface of the wall has a central flat part, matching the upper surface of stop-bar 136, with respective upwardly angled parts at its sides. Behind the wall 139, is formed a second channel with a flat base 140 parallel to, but at a higher level than, the base 138. As can be seen from the Figures, the side 137*a* is stepped upwardly alongside the whole of the flat base 140, and for part of the flat base 138 adjacent wall 139. The other side 137*b* is similarly stepped, with its part alongside the base 140 being in fact extended upwardly to a greater extent in that it forms the side arm 132 of the mounting part of the base component 128. Adjacent the wall 139, respective interior surfaces of sides 137*a* and 137*b* are formed with respective tongues 141, 142 which are identical to the tongues 134, 135 so that they can be received in the grooves 122, 123 of the drill bit holder when this is engaged at the setting means of the base component 128, these tongues being spaced from the wall 139 to allow the forwardmost part of the sides 118, 119 to be received therebetween, as shown in FIG. 13.

Accordingly as shown in that Figure, the drill bit holder can engage with the tongues 141, 142, with the remainder thereof being received generally in the first channel and having the adjustment nut disposed just above or in contact with the upper surfaces respectively of the lower parts of the stepped sides 137*a*, 137*b*, the bottom of the V-block engaging on the flat base 138 as shown.

Upstanding from the base 140 and disposed centrally thereof and parallel to the sides 137*a* and 137, is an upstanding drill bit distance set-up peg or stop 143, preferably of metallic material. The stop is in the general form a plate spaced rearwardly from the wall 139 approximately halfway along the second channel. The stop has a rearwardly upwardly sloping front face 144, and longitudinally slidably arranged in this second channel is a drill rotation set-up element 145. Arranged in the base 140 along respective opposite sides of, and parallel to, the stop 143, are a pair of equi-spaced slots, one of which 146 is shown in FIGS. 10 and 11.

The element 145 is in the form of a generally square block which has a V-shaped recess 147 in its front face, the respective facing angled sides of the recess converging towards the rear face of element 145. Said angled sides, as well as the respective front surfaces of the element 145 at opposite sides of the recess, may be formed with respective liners, each of which could be secured by adhesive or the like to the angled inner surface of the recess and the outer flat front surface adjacent thereto. Each liner may be anchored to its associated front face by having a turned-over end received in a slot in said front face. At the inner extremity of the recess, to which, as stated, the two angled faces thereof converge, there is a central through-slot which extends to the rear face of the element 145. However the through-slot does not extend through the full height of the element 145, but terminates short at the top thereof so as to leave an upper connection. However the through-slot is of such a height that it enables the stop 143 be received therethrough as the element 145 slides longitudinally relative to said stop, as will be described, in use. The two arms of the element 145 formed by the dividing through-slot 149, have respective projections 148, 149 on their respective lower surfaces, these projections snap-fitting into the pair of slots in the base 140, so as to retain the element 145 in engagement with the component 128 but to allow sliding thereof, in that the projections are of a shorter length than the slots. A forwardmost position of the element 145 can be defined by the front surfaces at respective opposite sides of the recess 147 engaging the wall 139. In this position the angled front face 144 of the stop 143 is received almost at the inner extremity of the recess 147, with its rear end projecting slightly from the rear of the element 145 out of the through-slot 149. However the forwardmost position of the element 145 could be rearwardly of this, but normally with the front faces at opposite sides of the recess being at least level with or forward of the front face 144. As far as the rearmost position of the element 145 is concerned, it is convenient for this to be either when its front faces at opposite sides of the recess are level with the front face 144, or alternatively when the flat rear face of the element 145 is flush with the rear of the component 128 defined by the sides 137*a*, 137*b*.

The element 145 can be retained other than by way of projections snap-fitting in respective recesses, for example by respective pegs on opposite sides of the element slidably engaging in slots in the respective sides 137*a*, 137*b*, without any snap-fit. Additionally the element 145 could be spring-biased forwardly, although this can make removal of the drill bit holder and clamped drill bit somewhat more difficult. This also suffers from the disadvantage that it can push the drill bit away from the stop 143 during clamping. In fact it may be possible to allow for longitudinal sliding of the element 145 without any specific guiding means other than the sides 137*a*, 137*b* and base 138. The sloping front face 144 of the stop peg 143 is designed to correspond to the angle on a drill bit. Instead of the whole of the front face sloping, it can be convenient for the lowermost part to be a vertical face with the sloping part extending therefrom partway up the peg.

Use of the setting arrangement will now be described.

Firstly after manually adjusting the loosely held drill bit 124 in the groove 121 to a first guess at its correct axial and rotational state, the holder is positionally engaged at the setting arrangement by sliding it downwardly towards the flat base 138 with the tongues 141, 142 being received in the grooves 122, 123 respectively, until the position generally shown in FIG. 13 is reached. At this time, or previous to the engagement of the drill bit holder, the drill rotation set-up element 145 is slid forward in the second channel to its forwardmost position, shown generally in FIG. 12, where the front face 144 of the stop 143 is at the rear of the recess 147.

Generally the initial rough positioning by guesswork of the drill bit in the drill bit holder will mean that when the drill bit holder is engaged in the first channel, as shown in FIG. 13, the drill bit tip will be spaced from the front face 144 in order to allow the holder to seat on base 138. If this is not the case, if the drill bit is too far forwardly out of the holder, it will be necessary to release any light clamping force on the drill bit and to move it away from the face 144. Alternatively the drill bit holder can be engaged in the first channel with the clamp bar 125 well clear of the groove 121, so that the drill bit can then be inserted, any clamping only taking place once correct adjustment has been effected. With this latter procedure, the drill bit is moved forwardly towards the stop 143, with the element 145 in its forwardmost position. This causes the opposite sides of the drill bit tip to engage the opposite sides of the recess 147 whilst the tip is still clear of the front face 144. This will particularly be the case with a larger drill bit, for example a 10 mm drill bit, with the result that continued forward movement of the drill bit will push the element 145 rearwardly along the second channel of the setting arrangement. This movement will continue until the drill tip engages the front face 144. This sets the correct longitudinally adjusted position of the drill bit and ensures that it projects from the drill bit holder by the distance X+Y, referred to in FIG. 5. In contrast to a 10 mm drill bit, a 3 mm drill bit may well touch the stop 143 and the sides of the V-shaped recess 147 without significantly moving the element 145 rearwardly, given its much smaller sideways extent. With either the wall 139 or the wall 139*a*, the drill bit engages the upper V-shaped or flat surface thereof respectively, such engagement being equivalent to engagement of the drill bit against stop-bar 136, described hereinafter.

In order to ensure correct sharpening of the drill bit when the 'set' drill bit in the drill bit holder is engaged with the grinding wheel, it is necessary to ensure that the corners C of the drill bit (FIG. 15) are correctly aligned, and this involves ensuring that these corners touch the sides of the V-shaped recess, in other words that the tip is not at 90° to the position shown in FIG. 15. Accordingly to check the drill bit rotational orientation, the drill bit can be rotated , i.e. twisted, in its longitudinally adjusted set position, or during longitudinal adjustment. If the longitudinal adjustment has been carried out with the orientation of the drill bit at 90° to that shown in FIG. 15, then this rotation will bring the corners to the FIG. 15 position, and this will generally cause a further slight rearwards movement of the element 145, as the greater sideways extent of the now correctly rotationally orientated drill bit engages the respective sides of the recess 147. Accordingly in the correct 'set' position, the tip of the drill bit engages the stop, and the respective opposite sides/corners of the drill bit engage the respective opposite sides of the recess, with annular rotation of the drill bit causing no further rearwards movement of the element 145. In this 'set' position, full clamping of the clamp bar 125 can be effected so that the drill bit is now set.

The drill bit holder is then removed from the setting arrangement and repositioned at the mounting part of the base component 128 as described. The remainder of the sharpening process is as described in the first embodiment. Accordingly the drill bit holder is gradually lowered towards the base 131 until the drill bit tip almost touches the grinding wheel. The grinding wheel is then switched on and the drill bit holder is gradually lowered whilst simultaneously with said lowering, the swivel base component 128, with the engaged holder, is swung about its pivot from side to side. The one drill bit face is sharpened by the rotating grinding wheel as the lowering and swinging movement takes place. The lowering is terminated when the drill bit engages the metal stop-bar 136, this corresponding to projection of the drill bit from its holder by the distance X, with a distance Y corresponding to the amount of the bit ground away by the sharpening process. A typical engagement angle of 118° between the drill bit and the grinding wheel is the same as the angle of engagement of the drill bit with the stop 143, i.e. when the drill bit is correctly set. The opposite drill bit face of the two faces shown in FIG. 15 is sharpened by removing the holder from the mounting part, turning it through 180° and re-engaging the holder by lowering it as described until the drill bit engages the stop-bar 136. As before, instead of this engagement being by the drill bit, it could be instead by any part of the holder, or by both the drill bit and the holder.

Accordingly it is ensured that the two faces are ground symmetrically, because each grinding operation stops when the datum stop-bar is engaged by the drill bit. The arrangement can be used with standard twist drill bits and also split point drill bits and others. The component 128 can be provided with adjustable stops to control the angular movement thereof to give appropriate backing-off and cutting angle. It could also be tiltable by suitable means to vary the drill tip angle. Such features are particularly desirable when sharpening split point drill bits. All other variations referred to in our prior specification apply equally, where appropriate, to the present invention.

It will, however, be appreciated, that the setting arrangement of this second embodiment could be used to provide a drill bit holder, with set drill bit, which could then be used with any appropriate matching mount for use with any appropriate sharpening means, the setting arrangement thus not being restricted to use with a grinding wheel as shown herein, either by way of a separate adapter or by way of the features of the adapter being integral with the grinding tool. It will be appreciated that instead of two symmetrically arranged angled engagement surfaces, the element 145 could have a single surface for engagement by the drill bit.

If axial and/or rotational adjustment of the drill bit in the drill bit holder is to be made by eye, this setting could be delayed so as not to take place until the drill bit holder is engaged at the top of the mounting cradle, and prior to the holder being lowered and the cradle pivotted as described.

It will be appreciated that the sharpening arrangement comprising the combination of a mounting part or cradle with location means, such as a datum stop bar, together with a drill bit holder engagable in two alternative orientations with the mounting part, can be utilised separately from an adapter, and also without being part of a grinding tool. In other words such a sharpening arrangement constitutes a further independent inventive aspect, which can be used with any suitable grinding means.

What is claimed is:

1. A method of sharpening a cutting tool with a grinding surface by removing a predetermined thickness of a cutting surface on said cutting tool, said method comprising:

mounting said grinding surface with respect to a fixed body;

pivotally mounting a guide on said body on a pivot axis oriented at an angle to said grinding surface;

fixing a tool to be sharpened in a tool holder;

mounting said tool holder on said guide for sliding motion with respect to said guide along a linear path directed parallel to said pivot axis and transverse to said grinding surface;

confining the motion of said tool holder, with respect to said guide, to said sliding motion along said linear path;

sliding said tool holder along said linear path until said tool abuts said grinding surface;

pivoting said mounting guide on said pivot axis while maintaining said tool in abutment with said grinding surface; and obstructing said tool holder from further movement along said linear path after said tool holder has moved along said linear path a predetermined distance as a function of said thickness.

2. The method of claim 1 wherein said confining step includes providing said guide and said tool holder with sliding tongue-and-groove joints that enable only sliding motion between said guide and said tool holder.

3. The method of claim 2 wherein said sliding step includes orienting said tool holder in an upright position when sliding said tool holder along said linear path, and orienting said tool holder in an inverted position when sliding said tool holder along said linear path.

4. An adapter for guiding the movements of a cutting tool with respect to a grinding plane, said grinding plane adapted to contain a tool-sharpener surface capable of sharpening at least first and second complementary cutting surfaces of a cutting tool by grinding a predetermined thickness of the complementary cutting surfaces, said adapter comprising:

a body fixed with respect to said grinding plane;

a mounting guide pivoted to said body for rotation about a pivot axis oriented at a first angle with respect to said grinding plane;

a tool holder having clamp means for adjustably clamping a cutting tool in a predetermined position within said tool holder;

joint means having a first joint fixed to said mounting guide and a second joint fixed to said tool holder, said joint means enabling said first joint to mate with said second joint such that said tool holder selectively mounts in said mounting guide in first and second orientations, said joint means having means for confining said tool holder to move with respect to said mounting guide along a linear path directed parallel to said pivot axis such that said first complementary cutting surface lies in said grinding plane when said tool holder is in said first orientation and said cutting tool is being sharpened, and said second complementary cutting surface lies in said grinding plane when said tool holder is in said second orientation and said cutting tool is being sharpened; and a limit means fixed on said mounting guide for limiting the extent of said confine d path by an amount that is a function of said predetermined thickness.

5. The adapter of claim 4 wherein said limit means includes a rigid arm fixed to said mounting guide for engaging a cutting tool and obstructing movement of said tool holder a long said confined path.

6. The adapter of claim 4 wherein said first joint mates with said second joint to form a sliding joint.

7. The adapter of claim 4 wherein said tool holder is in an upright position when in said first orientation and is in an inverted position when in said second orientation.

8. The adapter of claim 4 wherein said tool holder comprises a V-block capable of receiving an elongated cutting tool, a clamping jaw, and means for engaging said clamping jaw with said V-block to selectively clamp an elongated cutting-tool in said V-block.

9. The adapter of claim 4 wherein said body includes a platform having a planar surface sloped with respect to said grinding plane, and said mounting guide pivotally slides on said planar surface with said pivot axis perpendicular to said planar surface.

10. The adapter of claim 9 wherein said planar surface forms an obtuse angle with said grinding plane.

11. The adapter of claim 4 wherein said tool holder includes a seat with a longitudinal axis for holding an elongated drill bit with a tip to be sharpened, and further including a setting means for orienting an elongated drill bit in said seat along said longitudinal axis in preparation for sharpening.

12. The adapter of claim 11 wherein said setting means mounts on said mounting guide and comprises:

a tool-holder mount;

a tip-stop means for engaging a tip of a drill bit to be sharpened upon longitudinal setting of the drill bit in said seat when said tool holder is mounted in said tool-holder mount; and drill-rotation-setting means mounted for movement with respect to said tip-stop means and having tip-abutting surfaces for engaging complementary cutting surfaces of a tip to be sharpened, and moving said drill-rotation-setting means with respect to said tip-stop means until said tip to be sharpened engages said tip-stop means and at least one of the complementary cutting surfaces engages one of said tip-abutting surfaces.

13. The adapter of claim 12 wherein said drill-rotation-setting means includes at least one planar surface oriented at an angle to said longitudinal axis.

14. The adapter of claim 12 wherein said drill-rotation-setting means includes a pair of planar surfaces oriented at an angle with each other and with respect to said longitudinal axis to define a V-shaped recess.

15. The adapter of claim 14 wherein said pair of planar surfaces are separated by a slot located in a plane of said tip-stop means, whereby said slot receives said tip-stop means when said drill-rotation-setting means moves with respect to said tip-stop means.

16. The adapter of claim 12 wherein said tip-stop means includes a face sloping with respect to said longitudinal axis for engagement by a tip to be sharpened.

17. The adapter of claim 16 wherein said face has a slope angle that is a function of the angle between said grinding plane and said pivot axis.

18. The adapter of claim 12 wherein said tool-holder mount and said tool holder form a sliding tongue-and-grove joint.

19. A drill-bit-setting apparatus for setting, in a drill-bit holder, a drill bit having a tip to be sharpened, the drill-bit holder to be located adjacent a grinding surface for sharpening a tip of the drill bit, said drill-bit-setting apparatus comprising:

a mounting means for selectively mounting said drill-bit holder during setting of a drill bit;

a ti p-stop means for engaging a tip of a drill bit to be sharpened upon longitudinal setting of the drill bit in said tool holder along a longitudinal axis when mounted in said mounting means; and drill-rotation -setting means mounted for movement with respect to said tip-stop means and having a tip-abutting surface for engaging a cutting surface of a tip to be sharpened to move said drill-rotation-setting means with respect to said tip-stop means until said tip to be sharpened engages said tip-stop means and said cutting surface engages said tip-abutting surface.

20. The apparatus of claim 19 wherein said tip-abutting surface includes at least one planar surface oriented at an angle to said longitudinal axis.

21. The apparatus of claim 19 wherein said tip-abutting surface includes a pair of planar surfaces oriented at an angle with each other and with respect to said longitudinal axis to define a V-shaped recess located at a front of said drill-rotation-setting means.

22. The apparatus of claim 21 wherein said pair of planar surfaces are separated by a slot located in a plane of said tip-stop means, whereby said slot receives said tip-stop means when said drill-rotation-setting means moves with respect to said tip-stop means.

23. The apparatus of claim 19 wherein said tip-stop means includes a face sloping with respect to said longitudinal axis for engagement by a tip to be sharpened.

24. The apparatus of claim 23 wherein said face has a slope angle that is a function of the angle between said grinding plane and said pivot axis.

25. The apparatus of claim 19 wherein said mounting means and said tool holder form a sliding tongue-and-grove joint.

26. A tool sharpener for sharpening at least first and second complementary cutting surfaces of a cutting tool by grinding a predetermined thickness of the complementary cutting surfaces, said tool sharpener comprising:

a planar grinding surface;

a body fixed with respect to said planar grinding surface;

a mounting guide pivoted to said body for rotation about a pivot axis oriented at a first angle with respect to said planar grinding surface;

a tool holder having clamp means for adjustably clamping a cutting tool in a predetermined position within said tool holder;

joint means having a first joint fixed to said mounting guide and a second joint fixed to said tool holder, said joint means enabling said first joint to mate with said second joint such that said tool holder selectively mounts in said mounting guide in first and second orientations, said joint means having means for confining said tool holder to move with respect to said mounting guide along a linear path directed parallel to said pivot axis such that said first complementary cutting surface lies in said grinding plane when said tool holder is in said first orientation and said cutting tool is being sharpened, and said second complementary cutting surface lies in said grinding plane when said tool holder is in said second orientation and said cutting tool is being sharpened; and a limit means fixed on said mounting guide for limiting the extent of said confined path by an amount that is a function of said predetermined thickness.

27. The tool sharpener of claim 26 wherein said first joint mates with said second joint to form a sliding joint, and said tool holder is in an upright position when in said first orientation and is in an inverted position when in said second orientation.

28. The tool sharpener of claim 27 wherein said tool holder comprises a V-block capable of receiving a cylindrical cutting tool, a clamping jaw, and means for engaging said clamping jaw with said V-block to selectively clamp a cylindrical cutting-tool in said V-block.

29. The tool sharpener of claim 28 wherein said body includes a planar platform sloped with respect to said planar grinding surface, and said mounting guide pivotally slides on said planar platform with said pivot axis perpendicular to said planar surface and said planar platform forms an obtuse angle with said planar grinding surface.

* * * * *